US009872352B2

(12) United States Patent
Davis et al.

(10) Patent No.: US 9,872,352 B2
(45) Date of Patent: Jan. 16, 2018

(54) UNIVERSAL LED DIMMER WITH EXTENDED APPLICATION RANGE

(71) Applicant: Licon Technology Corporation, Santa Clara, CA (US)

(72) Inventors: Andrew Davis, Santa Clara, CA (US); Brent Dae Hermsmeier, Santa Clara, CA (US)

(73) Assignee: Licon Technology Corporation, Santa Clara, CA (US)

( * ) Notice: Subject to any disclaimer, the term of this patent is extended or adjusted under 35 U.S.C. 154(b) by 0 days.

(21) Appl. No.: 15/488,348

(22) Filed: Apr. 14, 2017

(65) Prior Publication Data

US 2017/0303359 A1 Oct. 19, 2017

Related U.S. Application Data

(60) Provisional application No. 62/322,349, filed on Apr. 14, 2016.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0848* (2013.01); *H05B 33/0806* (2013.01); *H05B 33/0884* (2013.01); *H05B 37/02* (2013.01)

(58) Field of Classification Search

None

See application file for complete search history.

(56) References Cited

U.S. PATENT DOCUMENTS

| | | | | |
|---|---|---|---|---|
| 9,084,306 | B1 * | 7/2015 | Bohler | H05B 37/02 |
| 2012/0274227 | A1 * | 11/2012 | Zheng | H05B 33/0815 315/210 |
| 2014/0167609 | A1 * | 6/2014 | Ryu | H05B 33/0848 315/85 |

* cited by examiner

*Primary Examiner* — Anh Tran

(74) *Attorney, Agent, or Firm* — Perkins Coie LLP

(57) ABSTRACT

A power supply circuitry compatible with both source type dimmer controls and sink type dimmer controls is provided. The power supply circuitry includes an internal voltage source, a dimmer control type detection circuit, and a configuration circuit. The dimmer control type detection circuit detects a type of a dimmer control that is electrically coupled to the power supply circuitry. The configuration circuit can turn off the internal voltage source upon determining the dimmer control is of the sink type and turn on the internal voltage source upon determining the dimmer control is of the source type. Thus, the internal voltage source may generate a voltage as the dimming control signal. The dimming control signal is fed to a microcontroller that may, for example, generate a series of pulse signals that is provided to a power converter of a load (e.g., light-emitting diode luminaries) based on the dimming control signal.

20 Claims, 8 Drawing Sheets

UNIVERSAL LED DIMMER WITH EXTENDED APPLICATION RANGE

CROSS-REFERENCE TO RELATED APPLICATIONS

This application claims the benefit of U.S. Provisional Patent Application No. 62/322,349 titled "Universal LED Dimmer with Extended Application Range" and filed on Apr. 14, 2016, which is incorporated by reference herein in its entirety.

RELATED FIELD

The present technology related to solid-state lighting technologies and, more specifically, universal power supplies that are compatible with existing 0-10V dimming standards (i.e., current source type and current sink type).

BACKGROUND

Lighting systems typically rely on conventional lighting technologies, such as incandescent bulbs and fluorescent bulbs. But these lighting technologies suffer from several drawings. For example, such light sources do not offer long life or high energy efficiency. Consequently, light-emitting diodes (LEDs) have become an attractive option for many applications.

A "light engine" is the LED equivalent of a conventional light source. Light engines include at least one LED that is mounted on a rigid/flexible board (also referred to as an "LED module") and an LED driver (also referred to as "electronic control gear"). Light engines are widely used in various applications, such as indicators, signs, light crystal display (LCD) backlights, automobile headlines, medical devices, and optical communications. For example, the LED module(s) may be disposed on a printed circuit board having electrical fixings and mechanical fixings that allow the printed circuit board to be readily fixed in a luminaire.

One challenge for LED technology is using conventional dimming control mechanisms (also referred to as "lighting control mechanisms") to control the light output level of an LED. One example of a conventional lighting control mechanism is a dimmer control that operates in accordance with an analog 0-10V lighting control protocol. In such instances, the control signal for the LED is a direct current (DC) voltage that varies between zero and ten volts to produce a varying intensity level. At intermediate voltages between 0V and 10V, the output curves of the LED can have various patterns. For example, an output curve could be linear for voltage output, actual light output, power output, or perceived light output. Typical 0-10V wiring diagrams are shown in FIG. 1A-B.

There are two existing 0-10V dimming standards: current source ("source") type and current sink ("sink") type. Because these dimming standards are not compatible with one another, it has historically been essential for a control system to understand which type is required for a given application.

The source type was originally developed for theatrical lighting applications. A source type dimmer control provides a separate 0-10V control voltage to each dimming channel that is connected to a luminaire. Thus, the source type dimmer control directly feeds the control voltage(s) to the LED(s). For the source type, 10V is defined as 100% of the designed potential output while 0V is defined as off (i.e., 0% light output).

The sink type was originally developed for controlling fluorescent dimming ballasts. A driver or a fixture control card generates a power signal that is delivered to a sink type dimmer control. The sink type dimmer control modulates the power signal between zero and ten volts by "sinking" its power with the driver, which in turn changes the control voltage. In other words, a power supply sinks the current and the sink type dimmer control provides the voltage for the LED(s). For the sink type, 10V (or above) is defined as 100% of the designed potential output. As the control voltage is reduced by the sink type dimmer control, the light output is reduced accordingly. However, the minimum control voltage defines and sets the minimum light output level. Thus, the minimum light output level depends on the driver. Some drivers' minimum light output level is off (i.e., 0% light output) while other drivers' minimum light output level is the lowest light level of the driver.

BRIEF DESCRIPTION OF THE DRAWINGS

One or more embodiments are illustrated by way of example and not limitation in the figures of the accompanying drawings, in which like references indicate similar elements.

DETAILED DESCRIPTION

Figure 1A:
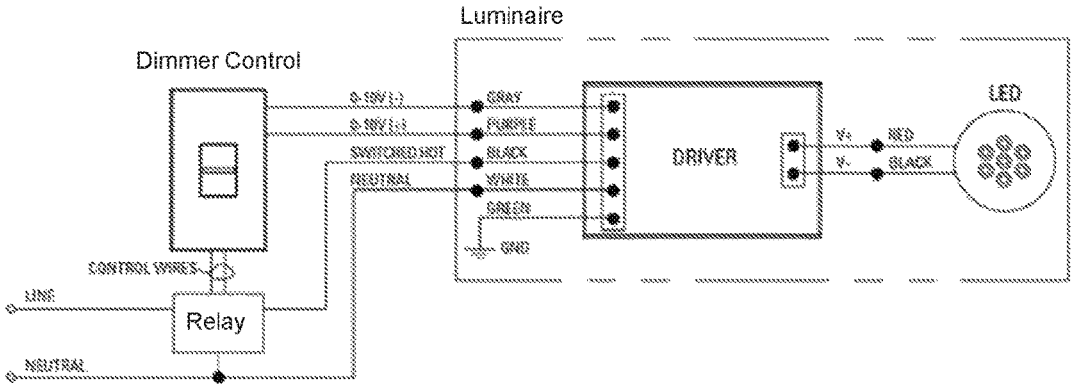
FIG. 1A depicts an example of a typical 0-10V wiring diagram that includes a relay for switching power.
Figure 1B:
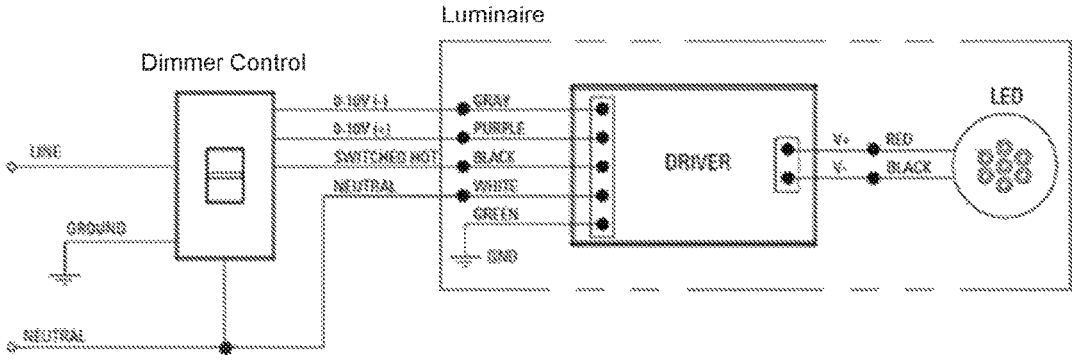
FIG. 1B depicts an example of a typical 0-10V wiring diagram that does not include a relay.

Introduced here are universal power supplies for solid-state lighting (SSL) technologies, such as light-emitting diodes (LEDs). More specifically, the universal power supplies described here are compatible with both existing 0-10V dimming standards (i.e., current source type and current sink type).

Commercial lighting systems require that a power supply provide dimming of the light output level using separate control signals that include dimming information. In one embodiment of the disclosed technology, a control signal of zero volts represents the minimum light output and a control signal of ten volts represents the maximum light output (i.e., full brightness). Within power supply circuitry, the control signal can be provided to a microcontroller that modulates the current delivered to a load (e.g., an LED array) in order to control the light output level. For example, the microcontroller may employ pulse-width modulation (PWM) by generating a series of pulses that are provided to a power converter of the load.

The power supply circuitry can then implement 0-10V dimming by either sinking current from an external dimmer control or sourcing current/voltage to an external dimmer control. For at least the reasons set forth above, it is advantageous for the power supply circuitry to facilitate both the source dimming method and the sink dimming method. Conventional implementations of source dimming or sink dimming limit the number of luminaries that can be connected to a lighting system due to the current limits or impedance capability of the dimmer control. Furthermore, luminaire manufacturers do not have industry-wide standards on the number of luminaries that can be controlled by either source dimming or sink dimming. Accordingly, luminaire manufacturers must limit their product features to accommodate the limitations of a few popular dimming controls. Thus, power supply circuitry with almost unlimited source dimming capability and sink dimming capability is desired.

Terminology

References in this description to "an embodiment" or "one embodiment means that the particular feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the words "comprise" and comprising" are to be construed in an inclusive sense rather than an exclusive or exhaustive sense (i.e., in the sense of "including but not limited to"). The terms "connected," "coupled," or any variant thereof is intended to include any connection or coupling, either direct or indirect, between two or more elements. The coupling/connection can be physical, logical, or a combination thereof. For example, two devices may be electrically and/or communicatively coupled to one another.

When used in reference to a list of multiple items, the word "or" is intended to cover all of the following interpretations: any of the items in the list, all of the items in the list, and any combination of items in the list.

Technology Overview

Figure 2:
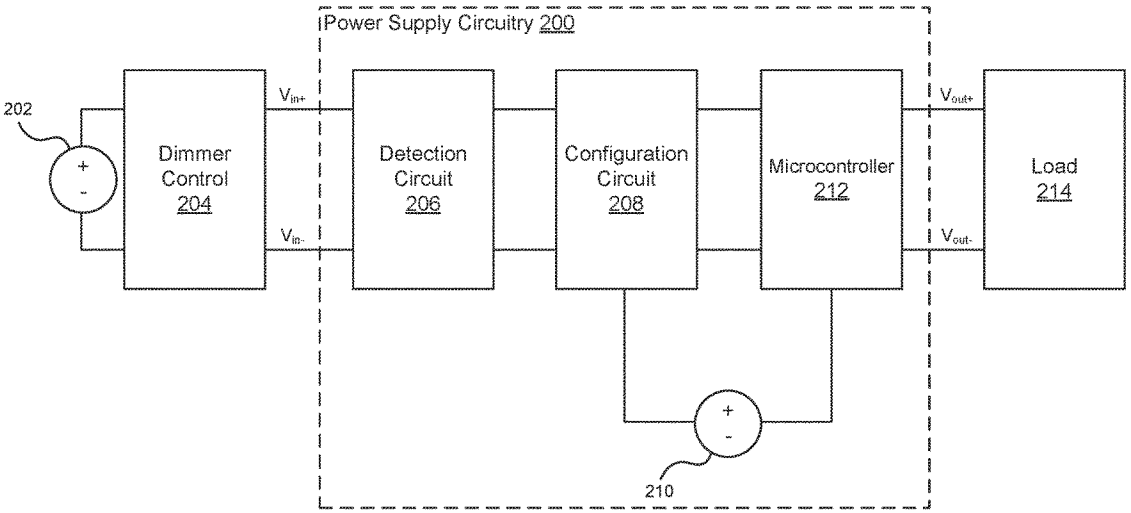
FIG. 2 is a block diagram illustrating an example of power supply circuitry that is electrically coupled to an external voltage source and a load.

FIG. 2 is a block diagram illustrating an example of power supply circuitry 200 that is electrically coupled to an external voltage source 202 and a load 214. The power supply circuitry 200 includes a dimmer control type detection circuit 206 (also referred to as a "detection circuit"), a configuration circuit 208, an internal voltage source 210, and a microcontroller 212. The power supply circuitry 200 may also be referred to as universal dimmer circuitry.

The input end of the power supply circuitry 200 (i.e., the input end of the dimmer control type detection circuit 206) can be connected to the dimmer control 204, which may be electrically coupled to the external voltage source 202. The external voltage source 202 can be a direct current (DC) electric power supply or an alternating current (AC) electric power supply. For example, the external voltage source 202 may be the mains electricity supply (also referred to as "household power," "wall power," or "grid power") at 100V, 110V, 120V, 220V, or 230V. In embodiments where the external voltage source 202 is an AC electric power supply, a rectifier (not shown) may convert the alternating current input into direct current output for forwarding to the dimmer control 204. One example of a rectifier is a bridge rectifier that includes a bridge of four (or more) rectifying diodes.

The dimmer control type detection circuit 206 receives the voltage from the dimmer control 204 (e.g., via input $V_{in}$). The dimmer control type detection circuit 206 is configured to detect the type of dimmer control 204 that is electrically coupled to the power supply circuitry 200. More specifically, the dimmer control type detection circuit 200 establishes the type based on whether a voltage is sensed coming from the dimmer control 204. If a voltage is sensed, the dimmer control 204 is identified as being a sink type dimmer control. However, if no voltage is sensed, the dimmer control 204 is identified as being a source type dimmer control. The dimmer control 204 may be any type of analog 0-10V dimmer control.

Upon identifying the type of the dimmer control 204, the configuration circuit 208 can take an appropriate action. For example, the configuration circuit 208 may turn off an internal voltage source 210 in response to determining that the dimmer control 204 is of the sink type. Such action ensures that the internal voltage source 210 does not generate voltage that interferes with the voltage provided by the dimmer control 204 as a dimming control signal. As another example, the configuration circuit 208 may turn on the internal voltage source 210 in response to determining that the dimmer control 204 is of the source type. Such action allows the internal voltage source 210 to provide a voltage as the dimming control signal since no voltage is provided by the dimmer control 204 in such instances.

The microcontroller 212 can detect the voltage level of the dimming control signal and employ pulse-width modulation (PWM) by generating a series of pulses that are provided to a power converter (not shown) of the load 214. Thus, the microcontroller 212 can control the operation of the load 214 by either (1) forwarding a dimming control signal provided by the dimmer control 204, or (2) modulating a dimmer control signal produced by the internal voltage source 210. The load 214 may include, for example, one or more LED modules.

Figure 3:
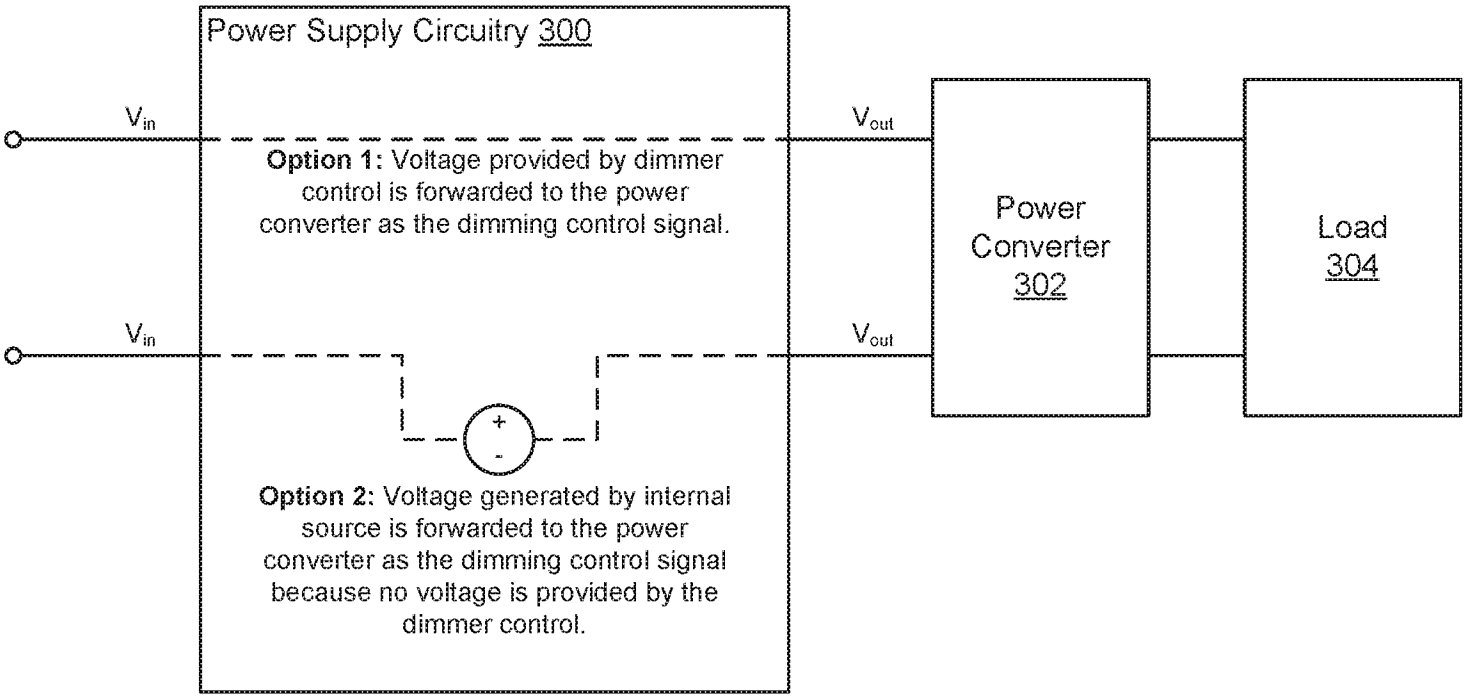
FIG. 3 is a block diagram illustrating voltage flow from the power supply circuitry to the load via the power converter.

FIG. 3 is a block diagram illustrating voltage flow from the power supply circuitry 300 to the load 304 via the power converter 302. As noted above, the power supply circuitry 300 is electrically coupled to a dimmer control (not shown). The power supply circuitry 300 establishes whether the dimmer control is a source type dimmer control or a sink type dimmer control based on whether voltage is sensed coming from the dimmer control (i.e., whether $V_{in}$ is zero or non-zero).

If the dimmer control is of the sink type, the power supply circuitry 300 can turn off an internal power source (not shown) so that the voltage provided by the dimmer control acts as the dimming control signal for the load 304. However, if the dimmer control is of the source type, the power supply circuitry 300 can turn on the internal power source in order to create the dimming control signal for the load 304.

The dimming control signal may be provided to a power converter 302 that converts the dimming control signal prior to reception by the load 304. The power converter can be, for example, a switch-mode DC-to-DC converter that converts a source of direct current (DC) from one voltage level to another. In other words, the power converter 302 may use a switch (not shown) to temporarily store the input energy and then release the energy at a voltage different than the input voltage. Note, however, that other types of DC-to-DC power converters could also be used (and, in some instances, may be more desirable). For example, the power converter 302 and a switch may form a boost converter, a buck converter, a flyback converter, a forward converter, a single-ended primary-inductor converter (SEPIC), a Ćuk converter, an LLC converter, or a step-up tapped-inductor converter.

The load 304, meanwhile, can include one or more LED modules having the same or different colors. For example, a luminaire may include red LED module(s), blue LED module(s), green LED module(s), or some combination thereof. One skilled in the art will recognize that certain combinations of LED module(s) are desirable for specific color models (e.g., RGB, RGBW, CMY).

The voltage drop across an LED module specifies how many volts are required to emit a light. In fact, each LED module has a desirable range of voltage drop. Accordingly, when the load 304 includes LED module(s), the power converter 302 may be designed to apply an appropriate voltage that is within the desirable range of the voltage drop.

Figure 4:
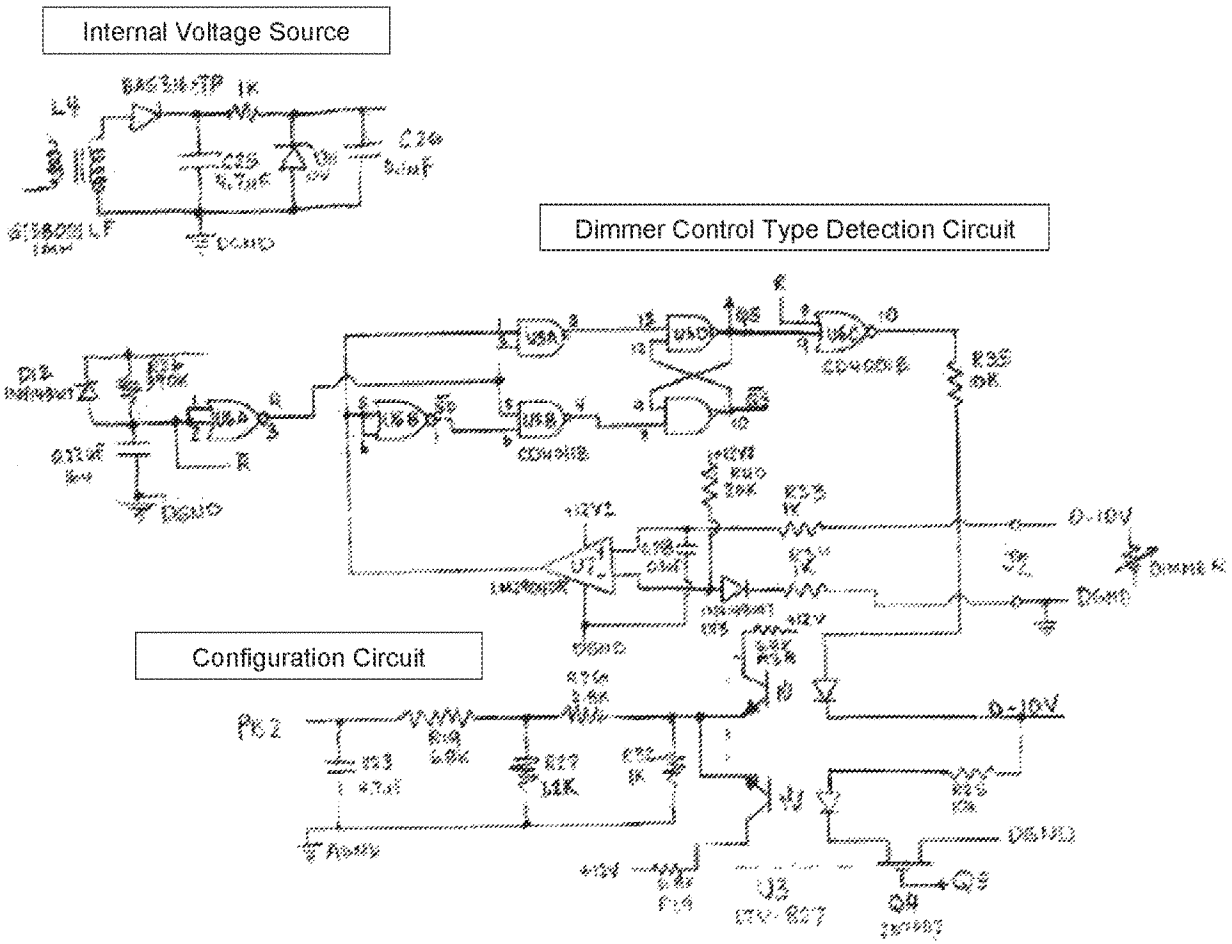
FIG. 4 is a schematic diagram of an example of power supply circuitry that includes a dimmer control type detection circuit, a configuration circuit, and an internal voltage source.

FIG. 4 is a schematic diagram of an example of power supply circuitry that includes a dimmer control type detection circuit, a configuration circuit, and an internal voltage source. At least one benefit of the power supply circuitry is an ability to provide almost unlimited source dimming and sink dimming for LED luminaries. Such a benefit is enabled by the following attributes.

First, the power supply circuitry is able to automatically detect the type of dimmer control (e.g., source type or sink type) that is connected to the power supply circuitry. The power supply circuitry can detect the dimmer control type by sensing the voltage provided by the dimmer control. If there is a voltage detected, the dimmer control is of the sink type. Otherwise, the dimmer control is of the source type. Detection circuitry (e.g., the dimmer control type detection circuit) can include a reset circuit (which may be included in the configuration circuit) that sets the logic of the power supply circuitry in the appropriate state when the power supply is initially turned on.

Second, a dimming circuit (which may also be included in the configuration circuit) can process the dimming signal information after detecting the type of dimming control established by the power supply circuitry. For sink dimming, the power supply circuitry detects a voltage on the dimming control inputs and turns off an internal voltage source so that the power supply circuitry does not generate voltage that interferes with the voltage provided by the sink type dimming control. This can be accomplished without any noticeable efficiency loss (e.g., only a very small amount of current (approximately several milliamps) is drawn by the internal power supply). For source dimming, the power supply circuitry does not detect a voltage on the dimming control inputs and turns on the internal voltage source. The voltage produced by the internal voltage source can then be applies as the dimming control signal for the fixture(s) (e.g., one or more LED light engines).

Third, the power supply circuitry can translate and transfer the dimming information to dimming circuitry (e.g., the configuration circuit 208 of FIG. 2) and the microcontroller (e.g., microcontroller 212 of FIG. 2) as the power supply circuitry detects a voltage on the input of detection circuitry (e.g., dimmer control type detection circuit 206 of FIG. 2), regardless of whether the dimmer control is configured for sink dimming or source dimming. The microcontroller may also generate variable pulse-width modulation (PWM) signals for a power converter that drives the load.

Fourth, the power supply circuitry can generate an isolated internal voltage as required for source dimming. More specifically, the power supply circuitry may include an internal voltage source that is selectively coupled to an output channel (e.g., via a switch) through which voltage can be provided to a load.

Figure 5:
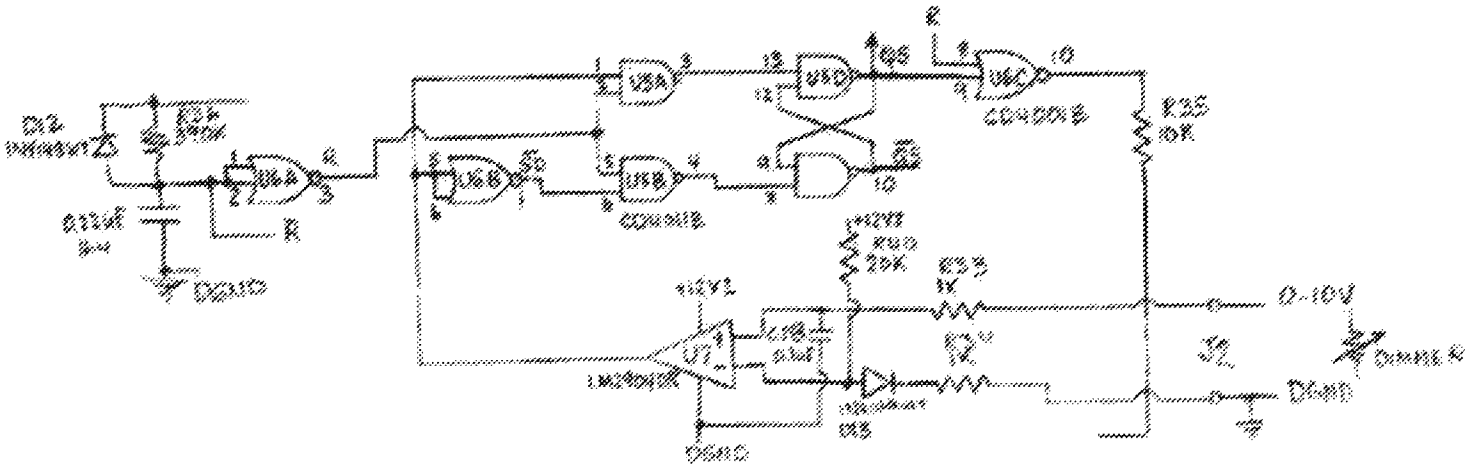
FIG. 5 is a schematic diagram of the dimmer control type detection circuit of the power supply circuitry.

FIG. 5 is a schematic diagram of the dimmer control type detection circuit of the power supply circuitry. As shown here, the dimmer control type detection circuit takes a voltage signal (e.g., a 0-10V voltage signal) provided by a dimmer control as input and then determines dimmer control type based on a presence of the voltage signal.

Figure 6:
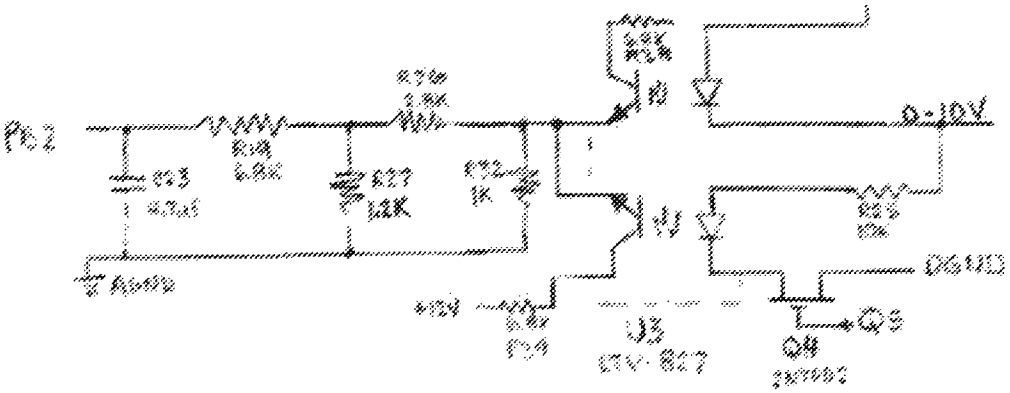
FIG. 6 is a schematic diagram of the configuration circuit of the power supply circuitry.

FIG. 6 is a schematic diagram of the configuration circuit of the power supply circuitry. As shown here, the configuration circuit includes a series of transistors that allow the configuration circuit to readily switch the source of the voltage from the external voltage source (sink type dimmer control) to the internal voltage source (source type dimmer control), and vice versa.

Figure 7:
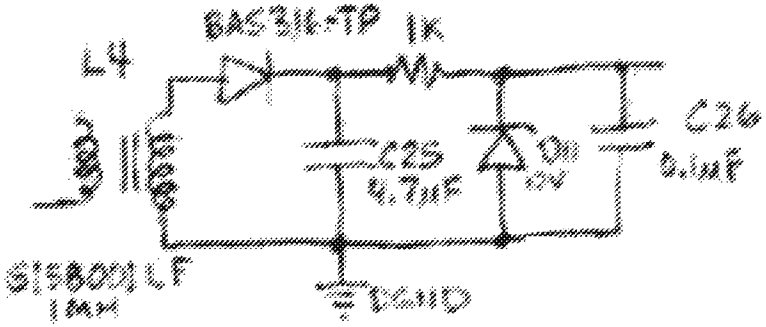
FIG. 7 is a schematic diagram of an example of the internal voltage source of the power supply circuitry.

FIG. 7 is a schematic diagram of an example of the internal voltage source of the power supply circuitry. The internal voltage source may be, for example, a low-voltage transformer having a magnetic core.

Figure 8:
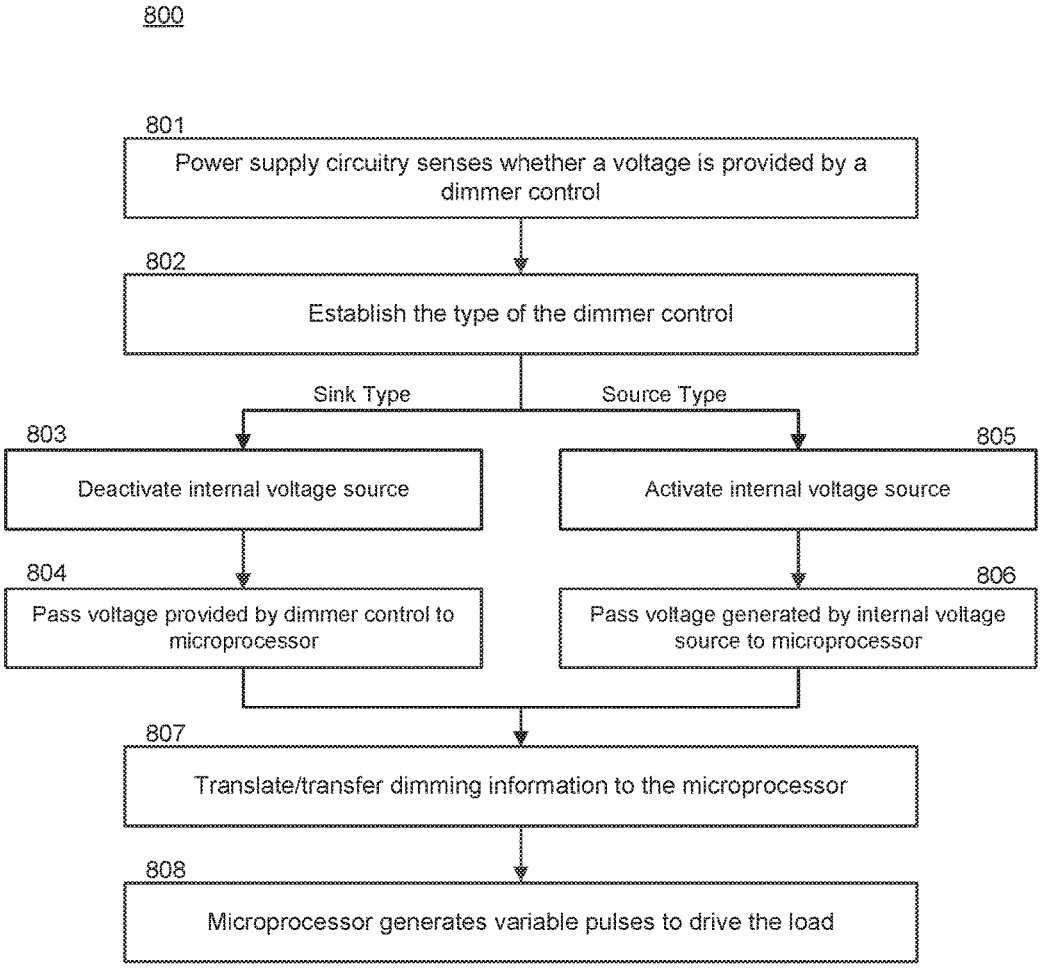
FIG. 8 depicts a process of seamlessly establishing which 0-10V dimming standard is appropriate for a given application The figures depict various embodiments for the purpose of illustration only. One skilled in the art will recognize that alternative embodiments may be employed without departing from the principles of the technology described herein.

As noted above, power supply circuitry for a universal power supply is introduced herein that is compatible with both existing 0-10V dimming standards (i.e., source type dimmer controls and sink type dimmer controls). At least one intent of such technology is to provide almost unlimited source dimming and sink dimming for LED luminaries. FIG. 8 depicts a process 800 of seamlessly establishing which 0-10V dimming standard is appropriate for a given application.

First, the power supply circuitry automatically senses whether a voltage is provided by a dimmer control that is electrically coupled to the power supply circuitry (step 801). The voltage may be sensed, for example, at the input end of a dimmer control type detection circuit. The power supply can then establish the type of the dimmer control based on the presence (or lack thereof) of the voltage (step 802). More specifically, the dimmer control type detection circuit can identify the dimmer control as a sink type dimmer control if a voltage is sensed and as a source type dimmer control if no voltage is sensed. Logic gate(s) may be used to set the logic of the power supply circuitry in the appropriate state.

Responsive to a determination that the dimmer control is a sink type dimmer control, the power supply circuitry can deactivate an internal voltage source (step 803) so that the internal voltage source does not interference with the voltage provided by the dimmer control. Deactivation may require the power supply circuitry turn off the internal voltage source or simply ensure the internal voltage source remains turned off. Moreover, the power supply circuitry can pass the voltage provided by the dimmer control to a microprocessor for further processing (step 804).

Responsive to a determination that the dimmer control is a source type dimmer control, the power supply circuitry can activate the internal voltage source (step 805). Activation may require the power supply circuitry turn on the internal voltage source or simply ensure the internal voltage source remains turned on. The power supply circuitry could also pass the voltage generated by the internal voltage source to the microprocessor for further processing (step 806). In such embodiments, the voltage generated by the internal voltage source can be applies as the dimming control signal for a load (e.g., one or more LED light engines).

As the power supply circuitry detects a dimming control signal (regardless of its origin), the power supply circuitry can translate and/or transfer dimming information downstream (step 807). For example, the dimming information may be provided to the microcontroller that modulates the dimming control signal prior to reception by the load. In some embodiments, the microcontroller employs PWM by generating a series of pulses that drive the load (step 808).

Unless contrary to physical possibility, it is envisioned that the steps described above may be performed in various sequences and combinations. For example, in some embodiments the process 800 is executed a single time when the power supply circuitry is initially turned on (i.e., the power supply circuitry is amenable to either dimming standard, but the dimmer control type is permanently set upon start up), while in other embodiments the process 800 is repeatable by the same power supply circuitry). Additional steps could also be included in some embodiments.

Although some embodiments are described in the context of analog 0-10V dimmer controls, one skilled in the art will readily appreciate that the technology can be applied to dimmer controls having any arbitrary voltage range. In some embodiments, the power supply circuitry can handle various voltage ranges with minimum number of components.

Moreover, the techniques introduced here can be implemented by programmable circuitry (e.g., one or more microprocessors), programmed software and/or firmware, special-purpose hardwired (i.e., non-programmable) circuitry, or a combination of such forms. Special-purpose circuitry includes application-specific integrated circuits (ASICs), programmable logic devices (PLDs), field-programmable gate arrays (FPGAs), etc.

Known electrical components (e.g., resistors, capacitors, logic gates, amplifiers, and diodes/rectifiers) may not be described in an effort to highlight the technology introduced here. However, these electrical components are clearly shown in FIGS. 4-7.

Remarks

The foregoing examples of various embodiments have been provided for the purposes of illustration and description. These examples are not intended to be exhaustive. Many variations will be apparent to one skilled in the art. Certain embodiments were chosen in order to best describe the principles of the technology introduced herein, thereby enabling others skilled in the relevant art to understand the claimed subject matter, the various embodiments, and the variations that may be suited to particular uses.

The language used in the specification has been principally selected for readability and instructional purposes. It may not have been selected to delineate or circumscribe the subject matter. Therefore, it is intended that the scope of the technology be limited not by this specification, but rather by any claims that issue based hereon. Accordingly, the disclosure of the technology is intended to be illustrative (rather than limiting) of the scope of the technology, which is set forth in the following claims.

What is claimed is:

1. A power supply circuitry comprising:
- an internal voltage source;
- a detection circuit configured to detect a type of a dimmer control that is electrically coupled to the power supply circuitry; and
- a configuration circuit configured to
  - turn off the internal voltage source in response to a determination that the dimmer control is of a sink type, which causes voltage provided by the dimmer control to act as a dimming control signal, and
  - turn on the internal voltage source in response to a determination that the dimmer control is of a source type, which causes voltage generated by the internal voltage source to act as the dimming control signal.

2. The power supply circuitry of claim 1, wherein the detection circuit detects the type of the dimmer control based on whether voltage is provided by the dimmer control.

3. The power supply circuitry of claim 2, wherein the type of the dimmer control is the sink type if voltage is provided by the dimmer control.

4. The power supply circuitry of claim 2, wherein the type of the dimmer control is the source type if no voltage is provided by the dimmer control.

5. The power supply circuitry of claim 1, wherein turning off the internal voltage source ensures that the internal voltage source will not generate voltage that would interfere with voltage provided by the dimmer control.

6. The power supply circuitry of claim 1, further comprising:
- a microcontroller configured to
  - detect a voltage level of the dimming control signal,
  - generate a series of pulse-width modulation (PWM) signals based on the voltage level, and
  - drive a load by providing the series of PWM signals to a power converter electrically coupled to the load.

7. The power supply circuitry of 6, wherein the load includes one or more light-emitting diode (LED) modules.

8. The power supply of claim 6, wherein the power converter is a switch-mode DC-to-DC converter that converts the series of PWM signals from a first voltage level to a second voltage level.

9. The power supply of claim 1, wherein the dimmer control is an analog 0-10V dimmer control.

10. A power supply circuitry comprising:
- an internal voltage source;
- a detection circuit configured to detect a type of a dimmer control that is electrically coupled to the power supply circuitry,
  - wherein the type is based on whether the detection circuit senses an input voltage provided by the dimmer control, the type being a sink type if voltage is detected and a source type if no voltage is detected;
- a configuration circuit configured to
  - turn off the internal voltage source in response to a determination that the dimmer control is of the sink type, which causes the internal voltage source to refrain from generating voltage that would interfere with the input voltage that acts as a dimming control signal, and
  - turn on the internal voltage source in response to a determination that the dimmer control is of the source type, which causes the internal voltage source to generate voltage that acts as the dimming control signal;
- wherein a voltage level of the dimming control signal is detected by a microcontroller that generates a series of pulse-width modulation (PWM) signals to drive a load.

11. The power supply circuitry of claim 10, wherein the load includes one or more light-emitting diode (LED) modules.

12. The power supply circuitry of claim 10, wherein the dimmer control is an analog 0-10V dimmer control.

13. The power supply circuitry of claim 10, wherein the internal voltage source is a low-voltage transformer having a magnetic core.

14. The power supply circuitry of claim 10, wherein the dimmer control is electrically coupled directly to an input of the detection circuit.

15. A method comprising:

determining, by a detection circuit, whether an input voltage is provided by a dimmer control;

in response to a determination that the input voltage is detected, establishing, by the detection circuit, that the dimmer control is of a sink type;

deactivating, by a configuration circuit, an internal voltage source; and directing, by the configuration circuit, the input voltage to a microprocessor as a dimming control signal; and in response to a determination that the input voltage is not detected, establishing, by the detection circuit, that the dimmer control is of a source type;

activating, by the configuration circuit, the internal voltage source; and directing, by the configuration circuit, voltage generated by the internal voltage source to the microprocessor as the dimming control signal.

16. The method of claim 15, further comprising:

detecting, by the microprocessor, a voltage level of the dimming control signal; and generating, by the microprocessor, a series of pulse-width modulation (PWM) signals based on the voltage level.

17. The method of claim 16, wherein the series of PWM signals is used to drive a load.

18. The method of claim 17, wherein the load includes one or more light-emitting diode (LED) modules.

19. The method of claim 15, wherein deactivation of the internal voltage source causes the internal voltage source to refrain from generating voltage that would interfere with the input voltage that acts as the dimming control signal.

20. The method of claim 15, wherein the dimmer control is a 0-10V dimmer control.

* * * * *